US005279202A

United States Patent [19]

Bellardi et al.

[11] Patent Number: 5,279,202

[45] Date of Patent: Jan. 18, 1994

[54] BOLT REPOSITIONING DEVICE FOR FIREARMS

[75] Inventors: Paolo Bellardi, Pesaro; Sergio Scaramucci, Gallo di Petriano; Rolando Caldari, Pesaro, all of Italy

[73] Assignee: Benelli Armi S.P.A., Urbino, Italy

[21] Appl. No.: 881,617

[22] Filed: May 12, 1992

[30] Foreign Application Priority Data

Jul. 29, 1991 [IT] Italy ..... MI91A002101

[51] Int. Cl.[5] ..... F41A 25/12

[52] U.S. Cl. ..... 89/198; 89/199; 89/44.01; 89/130

[58] Field of Search ..... 89/198, 44.01, 177, 89/199, 44.02, 178, 42.01, 130; 42/1.06

[56] References Cited

U.S. PATENT DOCUMENTS

| | | | |
|---|---|---|---|
| 447,836 | 3/1891 | Maxim | 89/177 |
| 580,924 | 4/1897 | Browning | 89/199 |
| 918,447 | 4/1909 | Hepburn | 89/199 |
| 1,472,126 | 10/1923 | Kewish | 89/198 |
| 1,877,839 | 9/1932 | Frommer . | |
| 2,093,169 | 9/1937 | Holek . | |
| 2,522,192 | 9/1950 | Porter | 89/198 |
| 2,900,877 | 8/1959 | McClenahan | 89/198 |
| 3,318,192 | 5/1967 | Miller et al. | 89/199 |
| 3,366,011 | 1/1968 | Sturtevant | 89/198 |
| 4,056,038 | 11/1977 | Rath | 89/199 |
| 5,060,555 | 10/1991 | Sater et al. | 89/198 |

FOREIGN PATENT DOCUMENTS

| | | | |
|---|---|---|---|
| 664561 | 8/1938 | Fed. Rep. of Germany | 89/199 |
| 944776 | 5/1956 | Fed. Rep. of Germany . | |
| 922904 | 6/1947 | France . | |
| 54461 | 5/1950 | France | 89/198 |

*Primary Examiner*—Stephen M. Johnson
*Attorney, Agent, or Firm*—Amster, Rothstein & Ebenstein

[57] ABSTRACT

A semiautomatic firearm including a recoil spring acting on the bolt for closing the breech after the ejection of the case. The repositioning device includes an auxiliary resilient member which cooperates with the recoil spring, so that although a low-rigidity spring suitable for weak cartridges is used, the weapon works correctly even when firing powerful cartridges. The device thus allows to use a wider range of cartridges and reduces the negative effects of recoil.

1 Claim, 7 Drawing Sheets

BOLT REPOSITIONING DEVICE FOR FIREARMS

BACKGROUND OF THE INVENTION

The present invention relates to a bolt repositioning device for firearms, particularly for semiautomatic rifles.

In this type of firearm, a compromise is normally made between the rigidity of the recoil spring and the setting of the system, so that the weapon can fire cartridges with a variable charge. Powerful cartridges in fact require a stronger recoil spring, which however does not allow a reliable operation of the bolt assembly when using weak cartridges. Vice versa, a less rigid spring, suitable for weaker cartridges, is insufficient when using powerful cartridges and causes operating problems such as, for example, a slowing down of the bolt closing action. The strong recoil impact also causes inaccuracy and discomfort for the gunner.

Adjustment systems are known, such as for example the barrel brake ring in long-recoil rifles, or the maximum-pressure valve in gas-intake rifles, by means of which it is possible to make the weapon suitable for the use of cartridges with different charges; however, this adjustment is effective for a narrow range of cartridges.

Furthermore, the progress made in the manufacture of cartridges, the introduction of steel shot, and the use of special cartridges in the sports field have further increased the gap between weak cartridges and powerful cartridges.

SUMMARY OF THE INVENTION

The aim of the present invention is to provide a device which allows, in a firearm with semiautomatic or automatic operation, to apply a low-rigidity recoil spring, which is thus suitable for weaker cartridges, but allows optimum operation of the bolt assembly even with the most powerful cartridges.

Within the scope of this aim, an object of the invention is to provide a device which is constructively simple and thus economical from the point of view of production.

A further object of the invention is to provide an absolutely reliable device.

Another object of the invention is to provide a device which can be adapted, without substantial modifications, to any type of semiautomatic firearm.

This aim, these objects and others which will become apparent hereinafter are achieved by a bolt repositioning device for firearms, comprising a bolt assembly moving between a closed position and an open position and operatively connected to a recoil spring, said recoil spring being adapted to deform under the action of a force generated by said bolt assembly when it passes from said closed position to said opening position during the firing of a cartridge, and being adapted to return said bolt assembly from said open position to said closed position, said recoil spring defining a deformation position when said bolt assembly is in said open position; said device being characterized in that it comprises an auxiliary resilient member operatively associated with said recoil spring so that said deformation position comprises a first partial deformation position and a second complete deformation position; said recoil spring having, in said partial deformation position, the maximum possible deformation while said auxiliary resilient member is not deformed; said spring and said auxiliary resilient member being, in said complete deformation position, both at least partially deformed; said partial deformation position being caused by a said smaller force, said complete deformation position being caused by a said greater force.

DESCRIPTION OF THE DRAWINGS

Further characteristics and advantages will become apparent from the description of a preferred but not exclusive embodiment of the invention, illustrated only by way of nonlimitative example in the accompanying drawings, wherein.

DESCRIPTION OF THE INVENTION

Figure 1:
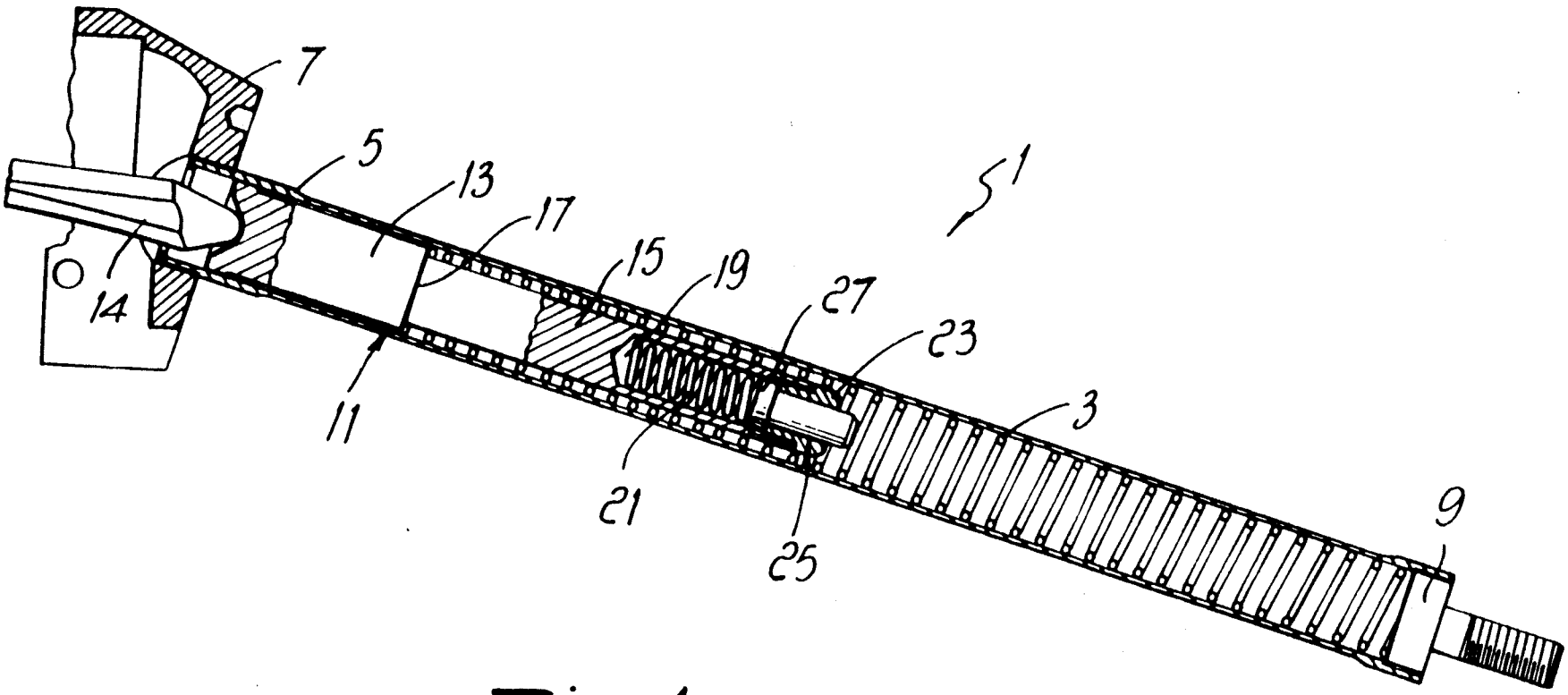
FIG. 1 is a sectional side view of the device according to the invention, applied to the recoil spring arranged in the stock of a semiautomatic rifle, in the closed position of the bolt assembly.
Figure 2:
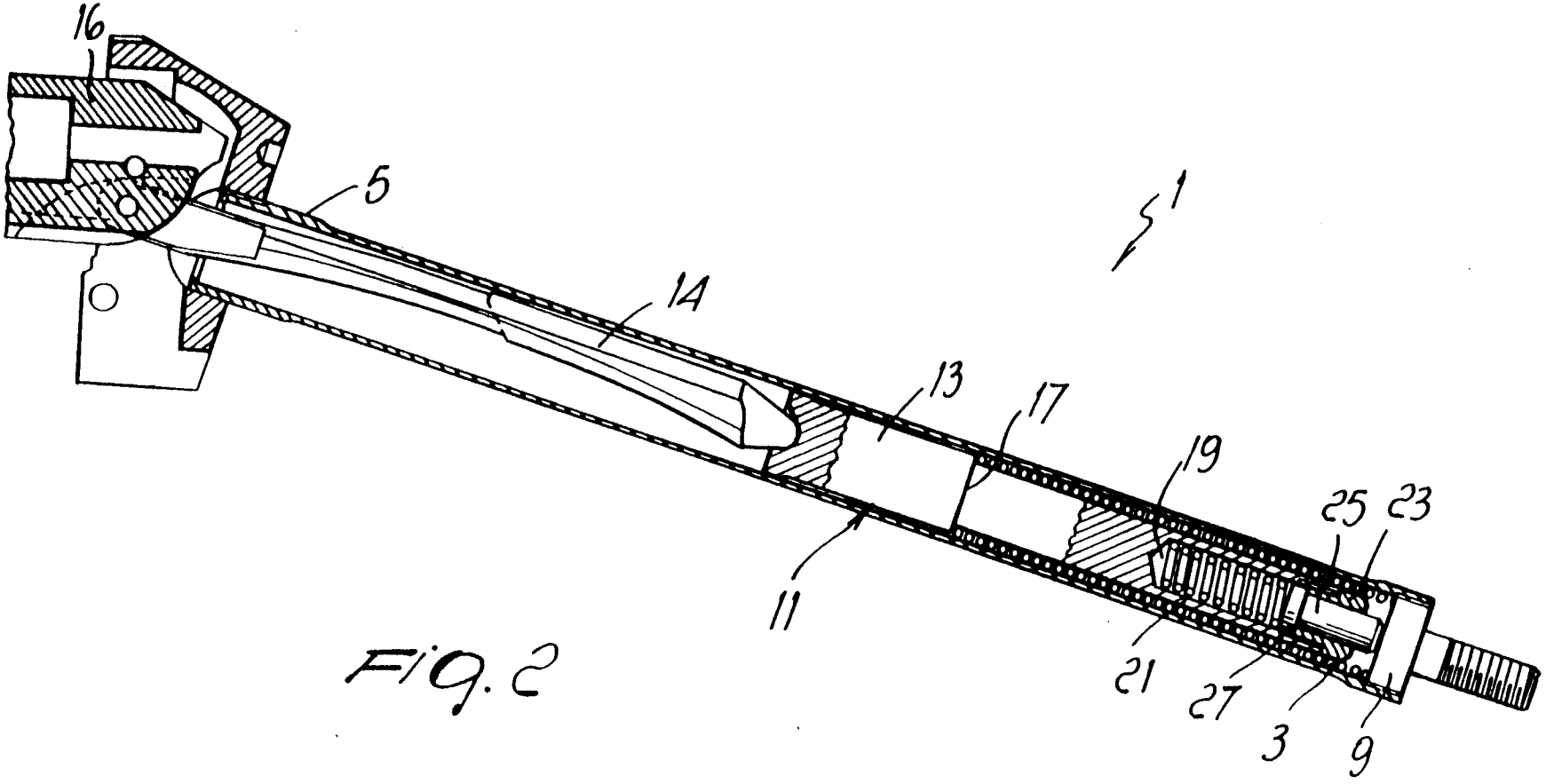
FIG. 2 is a view, similar to the preceding one, in the open position of the bolt assembly, the device being partially deformed.
Figure 3:
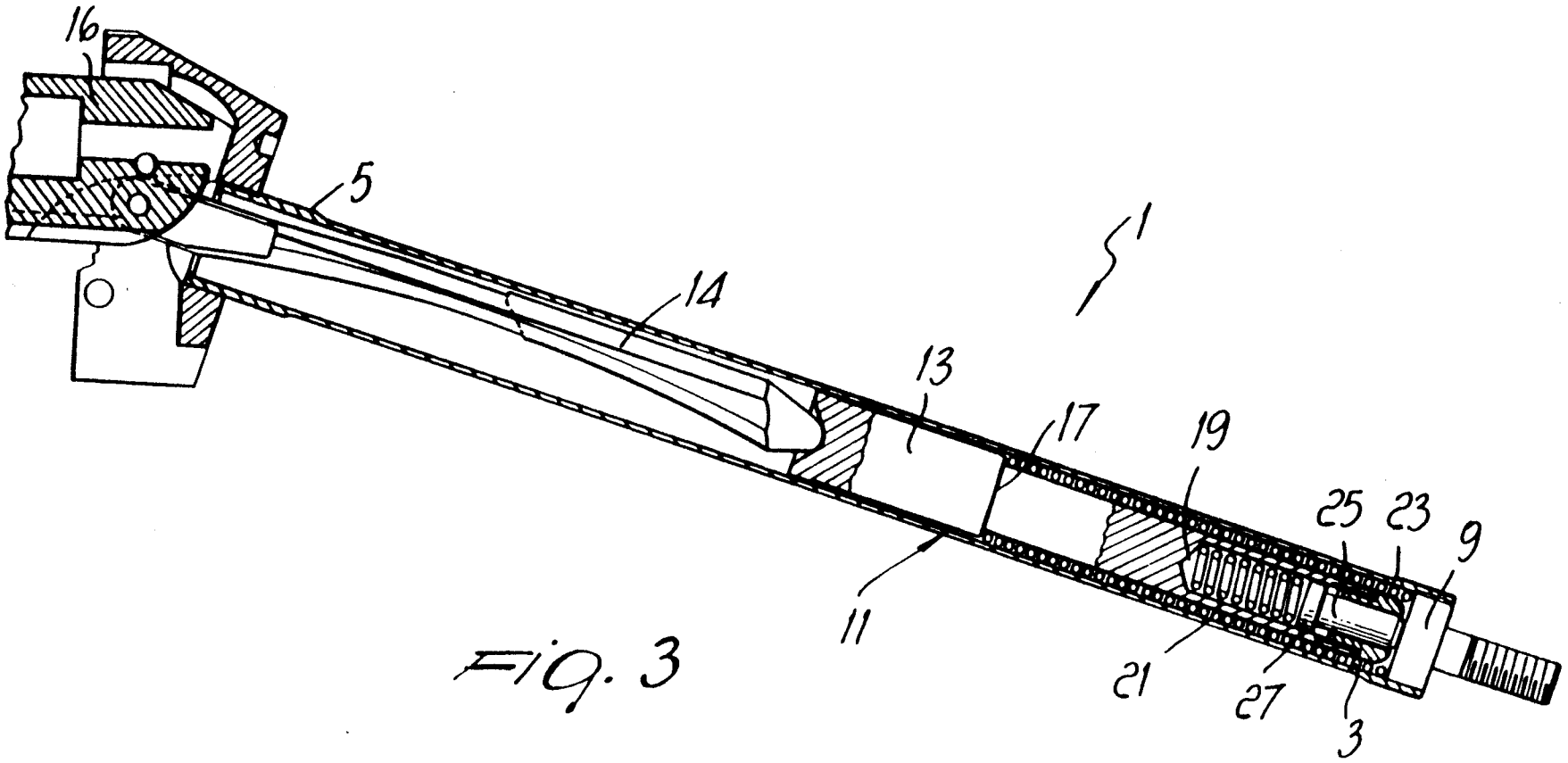
FIG. 3 is a view, similar to the preceding one, in the closed position of the bolt, the device being completely deformed.

With reference to FIGS. 1–3, the device according to the invention, generally designated by the reference numeral 1, is shown applied to the recoil or return spring 3, which is arranged in the stock (not shown) of an inertial semiautomatic rifle.

It is understood that the device described hereinafter by way of example with reference to inertial firearms can be applied to any other type of automatic or semiautomatic firearm.

In a per se known manner, the recoil spring 3 is accommodated in a cylindrical seat 5 which has one end associated with the weapon case 7 and comprises a bottom surface 9 at the opposite end; the spring furthermore has a first end which is associated with a spring guiding pin 11 and a second end which abuts against the bottom surface 9.

The spring guiding pin 11 is constituted by a first portion 13 and by a second portion 15 whose diameter is smaller than the first portion, so as to form an abutment 17 for the first end of the spring 3.

The first portion 13 has a free end which is operatively connected to a connecting rod 14. Rod 14 is connected to the bolt assembly 16, in a per se known manner.

The second portion 15 has a cavity 19. An auxiliary resilient member, which is advantageously constituted by an internal cylindrical helical spring 21, is arranged in the cavity 19.

The cavity 19 has an opening at the free end of the second portion; this opening is closed by a plug 23 which has an exit hole. An axial pin 25 is arranged in the cavity 19 and protrudes from the exit hole of the plug 23. The pin 25 has a flanged end 27 arranged inside the cavity 19 and in abutment on the internal spring 21.

The operation of the device is as follows: FIG. 1 illustrates the device in the position in which the bolt assembly is closed; during firing, the bolt assembly 16 moves backward, releasing the connecting rod 14 and deforming the spring 3, moving the device to the position illustrated in FIG. 2, with the pin 25 in abutment against the bottom surface 9. At this point, after the ejection of the case has been completed, the spring 3 returns the bolt assembly 16 to the initial closure position. In this first operating mode, with a weak cartridge the internal spring 21 is not deformed. In the second operating mode, with a powerful cartridge, the greater recoil energy of the weapon causes a further backward motion of the bolt assembly, illustrated in FIG. 3, deforming the internal spring member 21 as well. During the closure of the bolt, it is therefore the internal spring 21 that gives a further initial impulse to the connecting rod 14 and thus to the bolt assembly.

In practice it has been observed that the invention achieves the intended aim and objects by providing a device which allows optimum operation of the firearm with any type of cartridge.

The invention is extremely advantageous in application to inertial firearms and to the other types of automatic firearms.

The auxiliary resilient member acts only if powerful cartridges are used, so as to provide an additional thrust to the bolt assembly during the closure step, which would otherwise be too slow.

The auxiliary resilient member also effectively reduces the effects of recoil on the shoulder of the gunner, significantly improving shooting performance.

The device according to the invention is susceptible to numerous modifications and variations, all of which are within the scope of the inventive concept; all the details may furthermore be replaced with technically equivalent elements.

Figure 4:
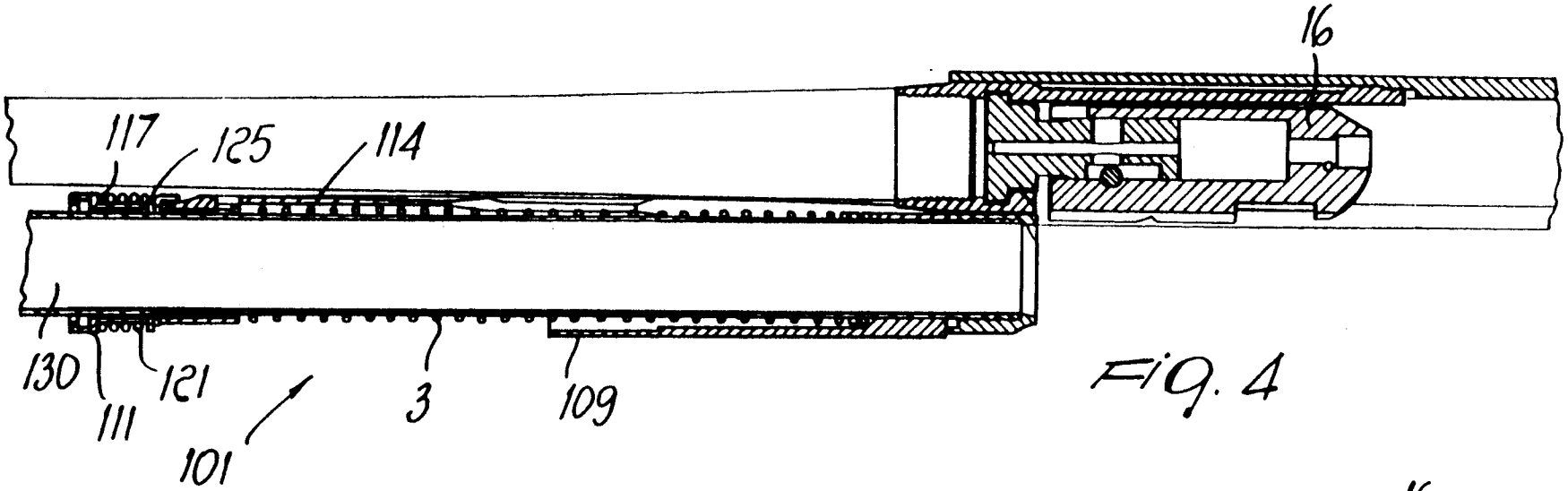
FIG. 4 is a schematic sectional side view of the device, according to another aspect of the invention, applied to the recoil spring arranged in front of the bolt assembly, illustrated in closed position.
Figure 5:
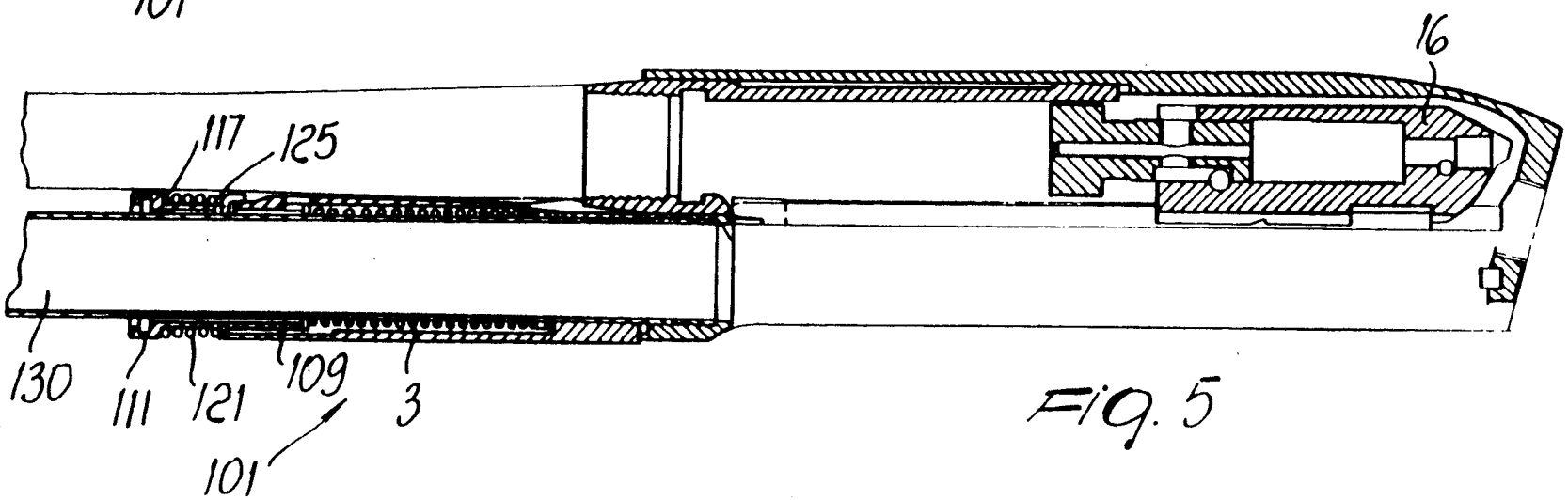
FIG. 5 is a view, similar to the preceding one, of the device in the partial deformation position.
Figure 6:
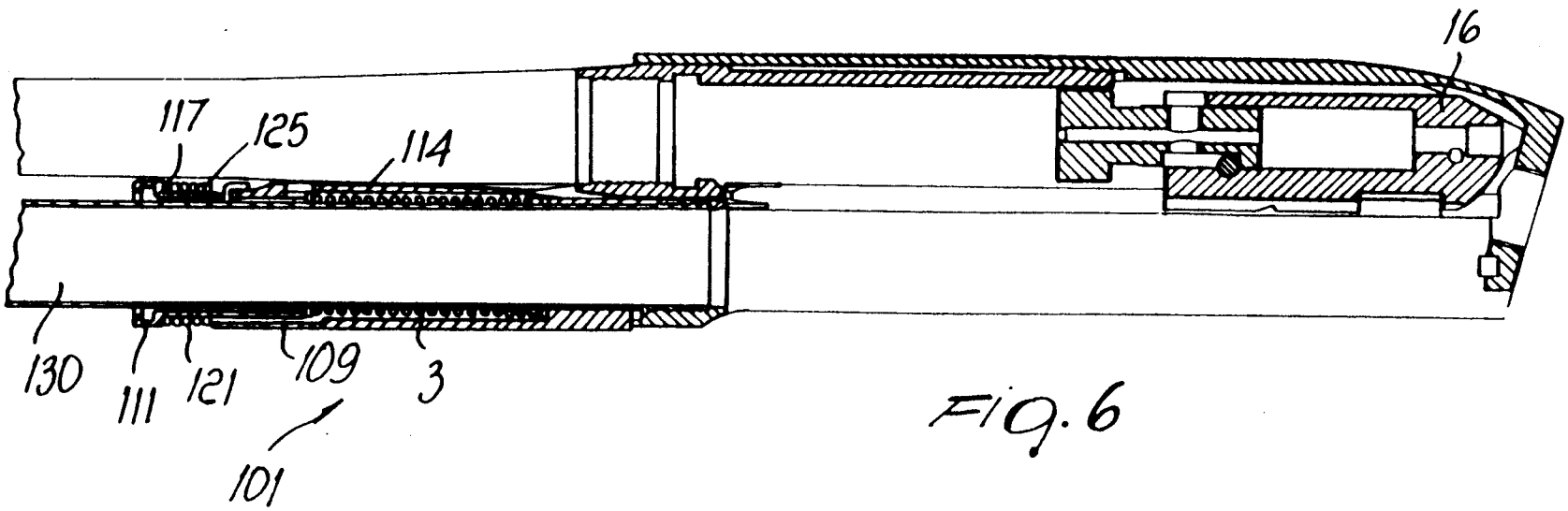
FIG. 6 is a view, similar to the preceding one, of the device in the complete deformation position.
Figure 7:
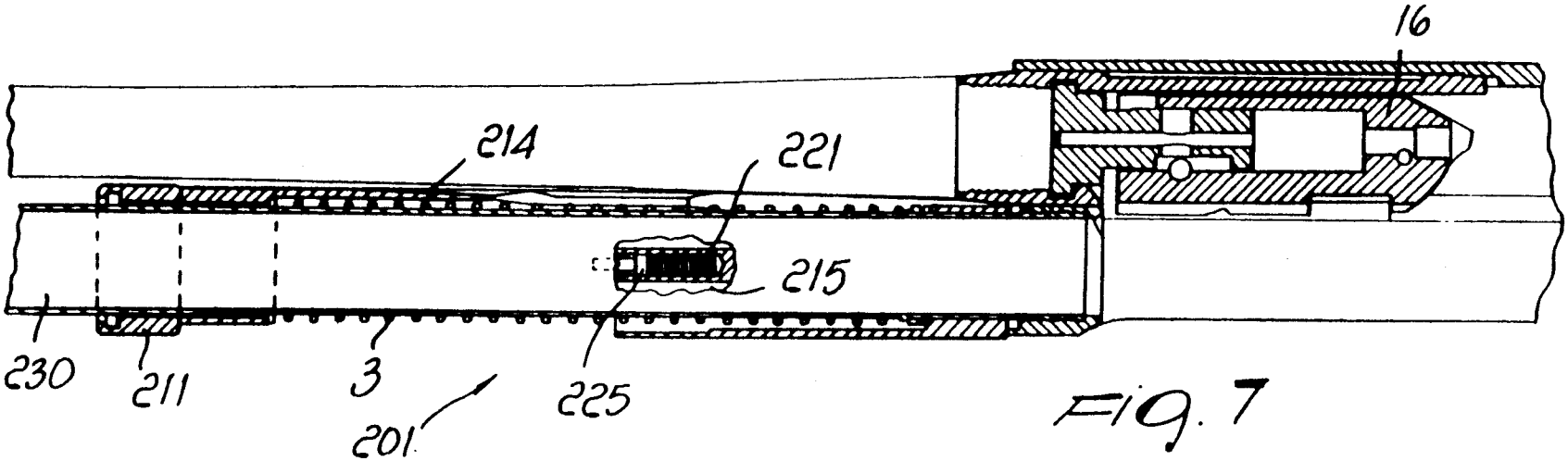
FIG. 7 is a schematic sectional side view of the device according to a third aspect of the invention, applied to the recoil spring arranged in front of the bolt assembly, illustrated in closed position.

FIGS. 4 to 6, for example, illustrate a device 101 applied to a semiautomatic rifle which is provided with a front recoil spring 3, i.e. with a recoil spring located in front of the bolt assembly and coaxial to the cartridge magazine 130. The bolt assembly 16 is connected to a sleeve 111 by means of a pair of brackets 114. The recoil spring 3 is operatively connected to the sleeve 111 in such a manner that it is deformed during the backward motion of the bolt assembly, as shown in FIG. 5.

The sleeve 111 comprises an auxiliary resilient member, advantageously constituted by a second cylindrical helical spring 121, arranged between an abutment 117 defined in the sleeve 111 and a ring 125. Ring 125 is coaxial to the sleeve and can slide thereon.

Similarly to the preceding case, if a weak cartridge is used, only the recoil spring 3 deforms during the backward motion of the bolt assembly, as shown in FIG. 5; if instead a more powerful cartridge is used, the backward motion of the bolt assembly moves the ring 125 of the sleeve 111 into abutment with an abutment element 109. The abutment element 109 is rigidly associated with the case of the firearm. The further backward motion of the bolt causes the deformation of the second spring 121 as well, as shown in FIG. 6.

FIGS. 7 to 12 illustrate a device 201, according to a further aspect of the invention, which can be applied to a firearm with front recoil spring. Similarly to the preceding case, the bolt assembly 16 is connected, by means of brackets 214, to a sleeve 211 which can slide on the magazine 230 and is operatively connected to a recoil spring 3.

The device 201 advantageously comprises a pair of springs 221. Each spring 221 is arranged in a hollow body, or seat, 215 provided on the case of the firearm and rigidly associated therewith. Each spring 221 acts on a pin 225 at least partially protruding at the front.

Figure 8:
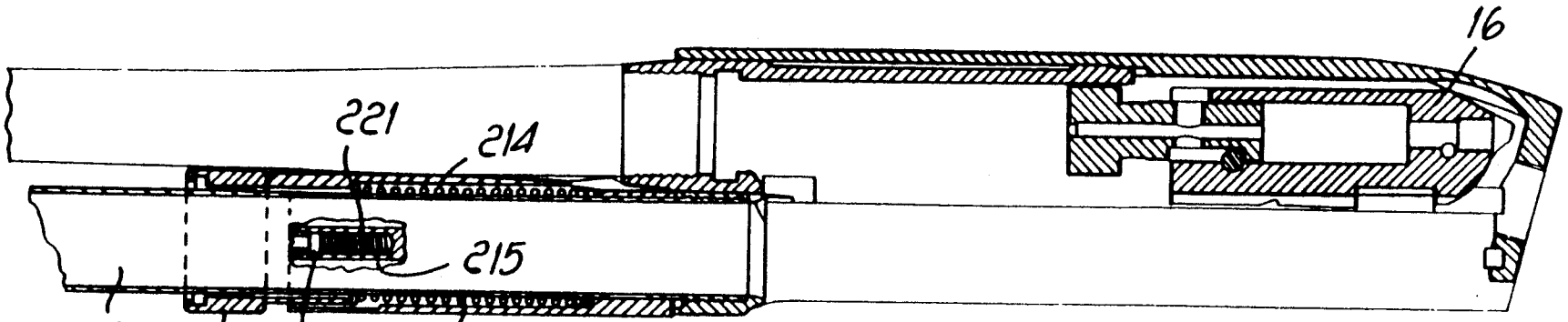
FIG. 8 is a view, similar to the preceding one, which illustrates the device in the partial deformation position.
Figure 10:
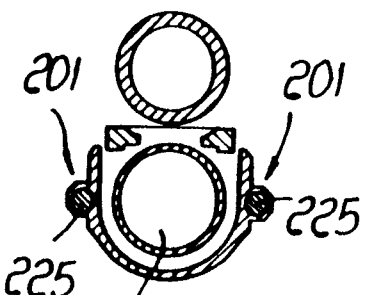
FIG. 10 is a schematic sectional front view of the device according to FIGS. 7–9.
Figure 9:
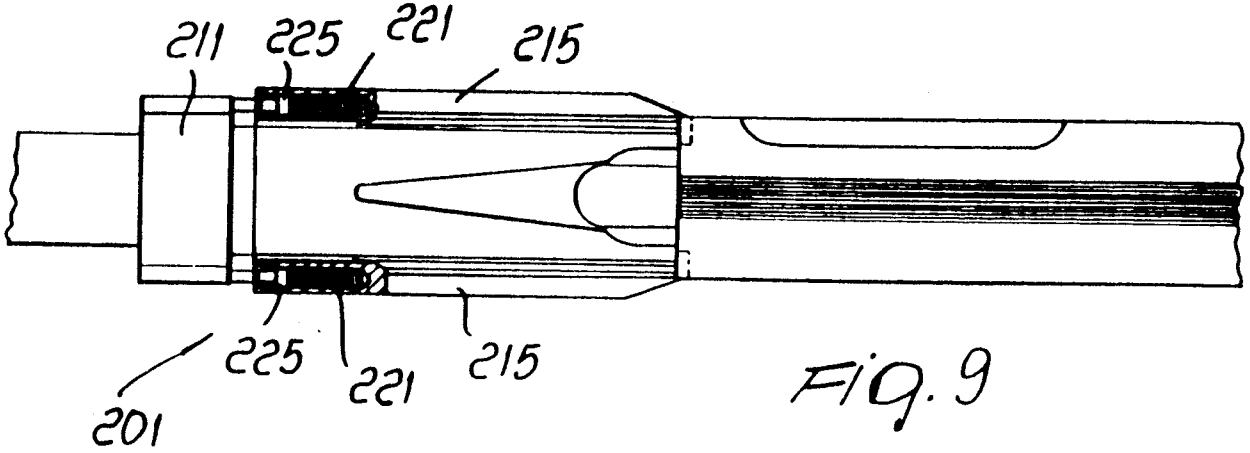
FIG. 9 is a sectional top view of the device according to FIG. 8.
Figure 11:
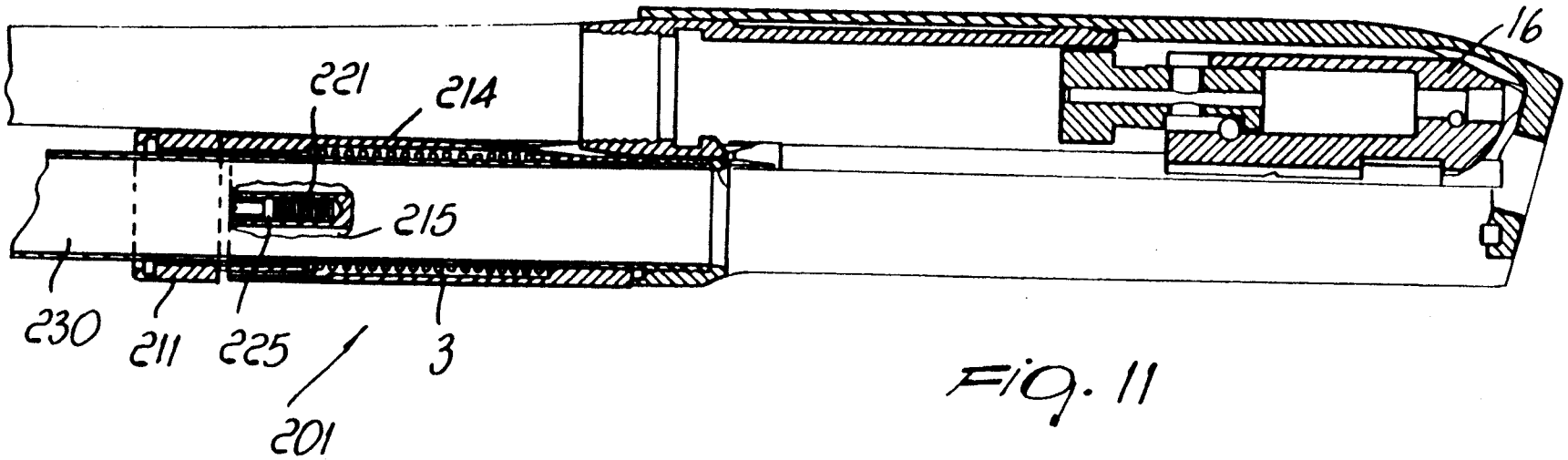
FIG. 11 is a view, similar to FIG. 8, of the device in the complete deformation position.
Figure 12:
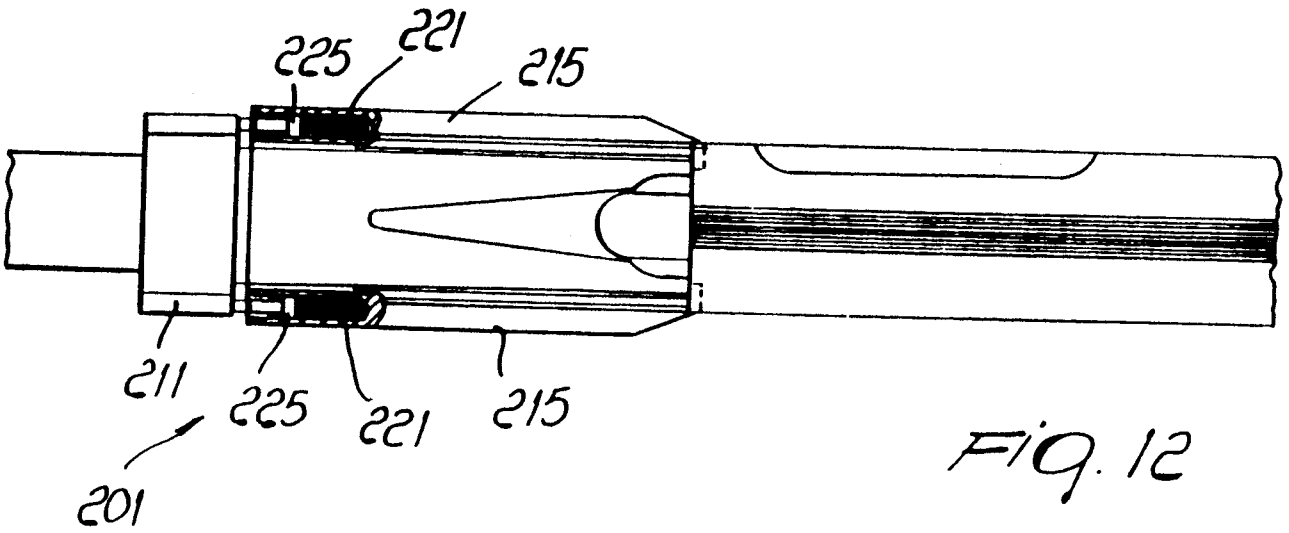
FIG. 12, finally, is a sectional top view of the device according to the preceding figure, in the complete deformation position.

FIGS. 8 to 10 illustrate the condition in which the bolt assembly is open and a weak cartridge is used; in this condition only the recoil spring 3 is deformed. Similarly to what has been described for the preceding cases, if a powerful cartridge is used, the greater kinetic energy of the recoil produces a greater thrust on the sleeve 211. The sleeve 211 abuts against the pins 225, protruding from the fixed seat 215, and this thrust produces the deformation of the auxiliary springs 221, as shown in FIGS. 11-12. The auxiliary springs 221 thus deformed therefore provide a further thrust during the closure of the bolt assembly.

The materials employed, as well as the dimensions, may naturally be any according to the requirements and the state of the art.

We claim:

1. Bolt repositioning device for firearms, comprising (A) a bolt assembly moving between a closed position and an open position and operatively connected to a recoil spring;

(B) said recoil spring being adapted to deform under the action of a force generated by said bolt assembly when it passes from said closed position to said open position during the firing of a cartridge, and being adapted to return said bolt assembly from said open position to said closed position, said recoil spring defining a deformation position when said bolt assembly is in said open position;

(C) an auxiliary resilient member operatively associated with said recoil spring so that said deformation position comprises a first partial deformation position and a second complete deformation position, said recoil spring having, in said partial deformation position, the maximum possible deformation without deformation of said auxiliary resilient member, said recoil spring and said auxiliary resilient member being, in said complete deformation position, both at least partially deformed, said partial deformation position being caused by a smaller force, and said complete deformation position being caused by a greater force than said smaller force; and (D) a spring guiding element which is coaxial to said recoil spring, said spring guiding element having a first end which is operatively connected to said bolt assembly and a second end which is adapted to abut against an abutment element when said bolt assembly is in said open position, said spring guiding element comprising a hollow body containing a spring element, said spring element being adapted to act on an axial pin, said pin being at least partially contained in said hollow body, said pin having a first extended position and a second retracted position; said pin being, when said recoil spring and auxiliary spring members are in said partial deformation position, in said extended position and being, when said recoil spring and auxiliary spring member are in said complete deformation position and said spring element is at least partially deformed, in said retracted position; said spring guiding element comprising:

(i) a first substantially cylindrical portion, said first cylindrical portion having said first end being operatively connected to a rod member pivoted to said bolt assembly;

(ii) a second substantially cylindrical portion having a diameter substantially smaller than a diameter of said first portion; and (iii) a region connecting said first portion and said second portion forming an abutment for a first end of said recoil spring;

said second portion comprising said hollow body and defining a substantially cylindrical cavity, said cavity having a bottom at a first end of said second portion and an opening at a second end of said second portion; said opening being closed by a plug having an exit hole; said pin being able to slide axially within said hole and having an outer end and a flanged end having a diameter substantially larger than said hole; said spring element being arranged in said cavity, said spring element having a first end in abutment with said bottom and a second end in abutment with said flanged end of said pin; said recoil spring being arranged in a spring seat and having a second end in abutment with a bottom surface of said spring seat defining said abutment element; said outer end of said pin being adapted to, in said partial deformation position, abut against said bottom surface without said spring element being substantially loaded; said outer end abutting, in said complete deformation position, against said bottom surface and loading said spring element so that said pin retracts into said cavity, said outer end moving flush to said hole.

* * * * *